US008065746B2

(12) United States Patent
Keeter

(10) Patent No.: US 8,065,746 B2
(45) Date of Patent: Nov. 29, 2011

(54) MULTI-SCORED WINGED COLLAR SUPPORT

(75) Inventor: Jim Keeter, Yellville, AR (US)

(73) Assignee: Capital Mercury Apparel, Ltd., New York City, NY (US)

( * ) Notice: Subject to any disclaimer, the term of this patent is extended or adjusted under 35 U.S.C. 154(b) by 793 days.

(21) Appl. No.: 11/892,664

(22) Filed: Aug. 24, 2007

(65) Prior Publication Data

US 2008/0047984 A1 Feb. 28, 2008

Related U.S. Application Data

(60) Provisional application No. 60/839,694, filed on Aug. 24, 2006.

(51) Int. Cl.
*A41B 3/00* (2006.01)
*D06C 15/00* (2006.01)

(52) U.S. Cl. ..... 2/129; 223/83

(58) Field of Classification Search ..... 223/2, 3, 223/4, 52.1, 83, 84, 81; 2/255, 257, 258, 2/129, 136, 60, 131, 132, 133, 134, 139, 2/274

See application file for complete search history.

(56) References Cited

U.S. PATENT DOCUMENTS 53,462 A * 3/1866 Mackay ..... 2/129
61,100 A * 1/1867 Ray ..... 2/136
313,547 A * 3/1885 Squires ..... 2/129
388,011 A * 8/1888 Barnard ..... 2/129
418,639 A 12/1889 Batter
440,027 A * 11/1890 Gibble ..... 2/132
562,827 A * 6/1896 Stone ..... 213/190
912,958 A 2/1909 Hawks
1,086,451 A 2/1914 Glasgow
1,102,431 A * 7/1914 Parsons ..... 2/129
1,280,673 A 10/1918 Cree
1,280,742 A 10/1918 Hurd
1,313,932 A 8/1919 Warshauer
1,814,760 A 7/1931 Miller, Jr.
1,879,527 A 9/1932 Sansone
1,911,638 A * 5/1933 Milburn ..... 223/83
1,945,104 A 1/1934 Zilinsky
1,953,429 A 4/1934 Newell
1,963,004 A 6/1934 Tucker
1,982,527 A 11/1934 Manekin
2,025,485 A 12/1935 Tucker
2,144,573 A * 1/1939 Krout ..... 223/83
2,385,638 A 9/1945 Norwood
2,585,689 A 2/1952 Schafer
2,630,949 A * 3/1953 Steele ..... 223/83
2,646,570 A 7/1953 Rinehart et al.
2,648,470 A * 8/1953 Calder ..... 223/83

(Continued)

*Primary Examiner* — Alissa L Hoey
*Assistant Examiner* — Amber Anderson
(74) *Attorney, Agent, or Firm* — Arent Fox LLP

(57) ABSTRACT

A winged collar support for a shirt collar including an elongated body portion having a first end, a second end and a center portion. A pair of wings protrudes from one of the first and second ends of the elongated body portion. The pair of wings has an inner side facing the center portion of the elongated body portion and an outer side opposite to the inner side. A plurality of rows of notches are formed in each wing. The plurality of rows of notches extend from the inner side of the wing to the outer side of each wing. Each notch extends from the surface of the wing to a depth of no more than half the thickness of the wing.

28 Claims, 4 Drawing Sheets

U.S. PATENT DOCUMENTS

| | | | | |
|---|---|---|---|---|
| 2,709,813 | A | | 6/1955 | Clendenin, Jr. |
| 2,713,686 | A | | 7/1955 | Oster et al. |
| 2,822,114 | A | * | 2/1958 | Noojin, Jr. et al. ..... 223/83 |
| 2,893,012 | A | | 7/1959 | Kahn |
| 3,072,306 | A | * | 1/1963 | Macrides ..... 223/84 |
| 3,142,843 | A | | 8/1964 | Berger |
| 3,170,165 | A | | 2/1965 | Wise |
| 3,200,413 | A | * | 8/1965 | Vaughan ..... 2/60 |
| 3,233,799 | A | * | 2/1966 | Abbey ..... 223/83 |
| 3,394,437 | A | | 7/1968 | Sinclair |
| 3,430,264 | A | | 3/1969 | Beukenkamp, Jr. |
| 3,536,554 | A | | 10/1970 | Weiss |
| 3,547,060 | A | | 12/1970 | Lepore |
| 3,587,501 | A | | 6/1971 | Cruden, Jr. |
| 3,629,866 | A | | 12/1971 | Blue |
| 3,654,635 | A | | 4/1972 | Cruden, Jr. |
| 3,675,279 | A | | 7/1972 | Moden |
| 3,701,167 | A | | 10/1972 | Spetz |
| 3,703,149 | A | | 11/1972 | George |
| 3,725,959 | A | | 4/1973 | Cruden |
| 3,793,647 | A | | 2/1974 | Spetz |
| 3,806,955 | A | | 4/1974 | Weyrick et al. |
| 3,828,365 | A | | 8/1974 | Berger |
| 4,000,522 | A | | 1/1977 | Swanson |
| 4,648,137 | A | | 3/1987 | Cooper |
| 4,670,908 | A | | 6/1987 | Albert |
| 4,825,472 | A | | 5/1989 | Garafano |
| 5,481,995 | A | | 1/1996 | Hiratsuka et al. |
| 5,692,240 | A | | 12/1997 | Steele |
| 5,898,941 | A | | 5/1999 | Groshens |
| 5,950,240 | A | | 9/1999 | Carpenter et al. |
| 6,057,253 | A | | 5/2000 | Groshens |
| 6,081,926 | A | | 7/2000 | Krause et al. |
| 6,212,686 | B1 | | 4/2001 | Krause et al. |
| 6,250,116 | B1 | | 6/2001 | Groshens |
| 6,401,257 | B1 | | 6/2002 | Tsuruta |
| 6,434,802 | B1 | | 8/2002 | Pannone |
| 6,874,164 | B2 | | 4/2005 | Droppo et al. |
| 6,986,165 | B2 | | 1/2006 | Neff et al. |
| 2004/0181845 | A1 | | 9/2004 | Droppo et al. |
| 2005/0022287 | A1 | | 2/2005 | Neff et al. |
| 2005/0125876 | A1 | | 6/2005 | Kato |
| 2005/0210561 | A1 | | 9/2005 | Robinson |
| 2005/0251891 | A1 | | 11/2005 | Keeter |

* cited by examiner

MULTI-SCORED WINGED COLLAR SUPPORT

CROSS-REFERENCE TO RELATED APPLICATIONS

This application claims the benefit of Provisional Application No. 60/839,694 filed in the U.S. Patent and Trademark Office on Aug. 24, 2006. The entirety of such Provisional Application is incorporated herein by reference.

BACKGROUND OF THE INVENTION

1. Field of the Invention

The present invention relates generally to a neck strip or support for a shirt collar that allows the shirt collar to maintain a predetermined form and position for display. The present invention also relates generally to a method of making the support for a shirt collar. The winged collar support of the present invention strengthens the roll and collar portions of the shirt and allows the roll and collar portions to be positioned vertically after folding so that the shirt can be displayed as desired.

2. Description of the Related Art

In the existing methods of finishing and packaging a dress shirt, several trim strips are used around a neckband to support a collar area of the shirt. The trim strips are usually plain rectangular paper or chipboard placed around the outside of the neckband under the collar, solid plastic butterfly placed under the neckband and collar; and a plastic "collar rider" placed around the neckband inside the neck opening.

However, the existing collar supports are primarily formed from a plurality of plastic trim strips such as the trim strips that are placed outside of the collar around the neckband and collar riders, trim strips that are placed inside of the neckband. The plastic trim strips forming the existing collar supports are generally not environmentally friendly as they are non-biodegradable. Other materials used for forming existing collar supports also require a plurality of trim strips to form a collar support. In addition, the stock used for existing collar supports is less than 0.0250 inches in thickness. Thus, the thin stock provides minimal support for the collar of displayed shirts.

The present invention solves the problems of rigid support for a collar portion of a shirt and the increased cost and time involved in applying multiple strips to form a collar support.

SUMMARY OF THE INVENTION

The present invention relates to a one-piece collar support having, in particular, multi-scored wings, for use in the display of dress shirts, such as, for example, men's dress shirts. The winged collar support forms and strengthens the neckband and collar area of a folded shirt for display. The winged collar support of the present invention allows the shirt to have a desired roll or shape in the collar and eliminates at least two additional normally used trim strips for supporting and strengthening the neckband and collar area of a folded shirt.

For example, the multi-scored winged portion of the collar support of the present invention also supports the neckband at the neckband opening, allowing the shirt collar to maintain a round or oval shape. As such, the collar rider, a plastic trim strip that is placed inside of the shirt collar for providing circumferential tension inside of the neckband during display of the shirt, is no longer needed.

The collar support of the present invention has a butterfly shape with, for example, curved or bubble-shaped wings, so that when the shirt is folded for display, for example, the multi-scored wings can be positioned under the collar points to provide a straight, rounded or other desired shape to the collar point. An operator can manually roll the wings along a row of scoring to create the desired curvature of the collar points.

The one-piece, multi-scored winged collar support of the present invention is formed of a heavy stock paperboard or chipboard that performs the functions of the plurality of traditionally used trim strips for forming collar supports. As such, the present invention provides cost savings over expensive petroleum-based plastic trim strips used for collar supports and cost savings over the related labor for forming and positioning the plurality of plastic trim strips as collar supports.

A slit can be provided in the body portion of the collar support for engagement by a tab or the like on an inner shirt board or an outer shirt package member.

The collar support can be made from, for example, recycled paperboard products from sources such as paper mills. The recycled paperboard products include, but are not limited to, "chip stock" materials that generally have a brown color on both sides or a refined "newsback" that has a white, clay coating with gray backing. In addition, the recycled paperboard products of the present invention can be 100% bio-degradable and further recyclable.

The weight of the stock from which the collar support can be made ranges from 0.0250" to 0.0290" in thickness, which is a greater thickness than the material used in existing collar supports.

Scoring or notches are provided in the wings to facilitate the folding of the wings to the desired height of the collar. The scored notches in accordance with the present invention are non-breakable when folded because the depth of the scoring is limited to less than the thickness of the wing and adjacent scorings are spaced apart. Therefore, the winged collar support of the present invention is able to maintain the desired shape and rigidity for displaying the shirt.

Perforations, however, that extend through the material so as to form holes tend to break, causing the collar support to tear where folded. As such, the collar support loses rigidity when the wings are folded over into the desired curved shape of the collar. Thus, perforations are unable to perform the function of maintaining the form of the collar support. The scored notches in accordance with the present invention are non-breakable when folded because the depth of the scoring is limited to less than the thickness of the wing. Therefore, the collar support of the present invention is able to maintain the desired shape and rigidity for displaying the shirt.

The thickness of the collar support provides support to both inside of the neckband area of the shirt and the collar portion. The wings in the collar support of the present application are rounded, having a curved perimeter edge and tapered along both the upper and lower edges, so that, for example, the support can be formed to any tapering of the shirt collar and not protrude from the collar of the shirt. The scoring in the wings, in combination, provide a collar support that is flexible, yet sturdy in use and adjustable for different sized collars, wherein different sizes include, in particular, collars for different heights.

As a result of the present invention, wherein only a single trim strip or strip of material is necessary, manufacturers of the collar supports and displayers of shirts can realize cost savings over collar supports using multiple trim strips to form a collar support. As a further result of the present invention, labor productions costs can be reduced because only one trim strip would need to be handled and positioned, as opposed to a plurality of trim strips. Moreover, the winged collar support of the present invention yields a more environmentally friendly garment by eliminating two or three plastic trim strips in favor of only a single trim strip formed from a renewable and recyclable chipboard material.

BRIEF DESCRIPTION OF THE DRAWINGS

The features of the invention will be more readily understood with reference to the following description and the attached drawings, wherein.

DETAILED DESCRIPTION OF THE INVENTION

Figure 1:
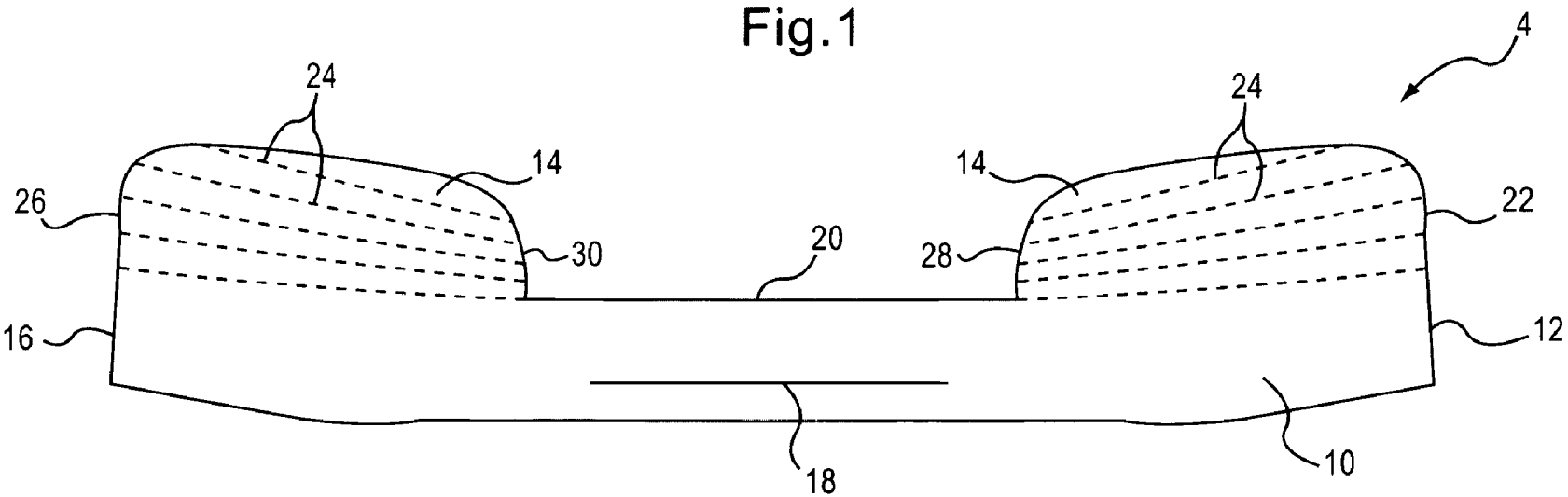
FIG. 1 illustrates the winged collar support in a flat state prior to use, according to an embodiment of the present invention.

In the different figures, the same reference numerals designate identical or similar features or components.

The scoring or notches are embedded in the winged collar support on only one side of the wings and do not form a hole therethrough.

Figure 2:
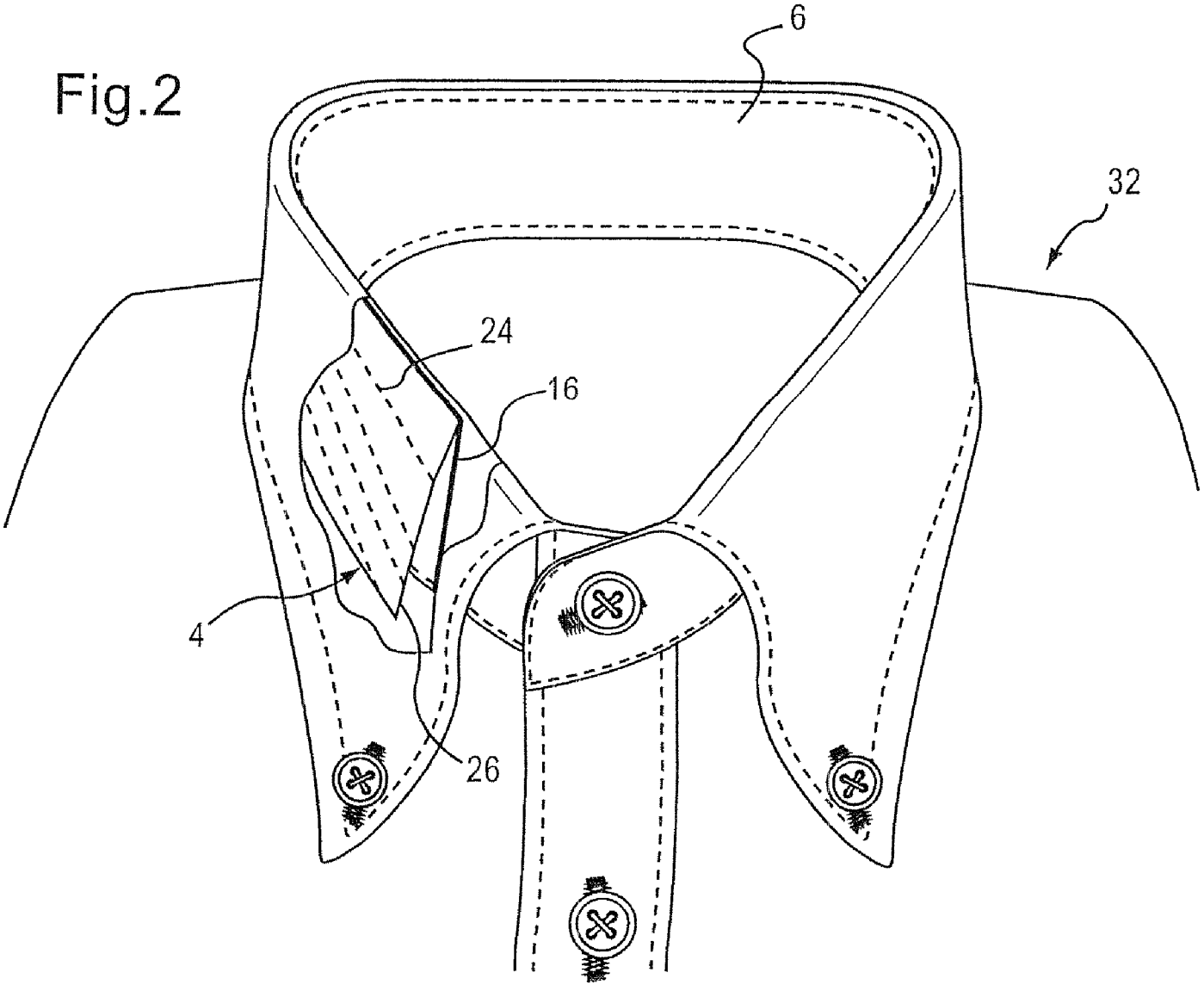
FIG. 2 illustrates a folded dress shirt with the winged collar support in operation, holding the collar points with a desired roll, according to an embodiment of the present invention.

As shown in FIGS. 1 and 2, the present invention relates to support 4 for a shirt collar 6. The winged collar support includes an elongated body portion 10 having a first end 12, a second end 16 and a center portion 20. The first end 12 and second end 16 of the elongated body portion 10 are at opposite longitudinal ends of the winged collar support 4. A pair of wings 14, 14 protrude from each of the first 12 and second 16 ends of the elongated body portion 10. The wings 14, 14 protrude outwardly from the same edge of the elongated body portion 10, and in the same direction, as shown in FIG. 1. The elongated body portion 10 and pair of wings 14, 14 are integrally formed from a single piece or sheet of material having a uniform thickness.

As each of the pair of wings 14, 14 are disposed at the first 12 and second 16 ends of the elongated body portion, the center portion 20 is shorter in height than the first and second ends. The wing 14, 14 have inner sides 28, 30 that face the center portion 20. Outer sides 22, 26 of the wings 14, 14 are opposite to the inner sides. The pair of wings 14, 14 can have curved perimeter edges, as shown in FIG. 1. The wings have curved perimeter edges and can be rounded. In addition, the upper and lower perimeter edges of the collar support are tapered toward the center portion 20, so that in operation, the support member can be hidden from view underneath the collar.

Each wing of the present invention has several rows of scoring or notches 24 formed therein for facilitating the folding or rolling of the wing into the desired shape for supporting the shirt collar 6. The rows of notches or scoring 24 extend longitudinally between the inner sides 28, 30 of the wings 14, 14 and the outer sides 22, 26 of the wings. The rows of scoring 24 are arranged substantially parallel to a bottom surface of the elongated body portion 10. The scoring 24 are embedded in each of the pair of wings 14, 14 on one surface only. For example, the scoring 24 in the wings 14, 14 can be embedded in the wings to a depth, from the surface of the wings, up to one-half of the thickness of the wings. As such, the scoring 24 is does not form a hole completely through the wings. The depth of the scoring 24 allows the winged collar support 4 to be easily folded; however, as the scoring does not form a hole through the wings, the collar support is able to maintain its desired shape and not break along the folded scoring when adjusted to the desired collar height.

The different rows of scoring 24 allow the winged collar support 4 to be folded to accommodate different heights of shirt collars. For example, the winged collar support 4 of the present invention can be adjusted to fit a shirt collar that has a low height by folding the winged collar support at a row of scoring that is closer to the elongated body portion 10, while a shirt collar that has a high height can be folded at scoring that is farther away from the elongated body portion.

The scoring 24 in each row of the wings can be formed adjacently to each other through the entire length of the wings as shown in FIGS. 1 to 4. The ends of each score are non-contiguous due to a space provided between each score in the row. The space between each score allows the winged collar support 4 to maintain rigidity when folded along the row of scoring 24.

Figure 4:
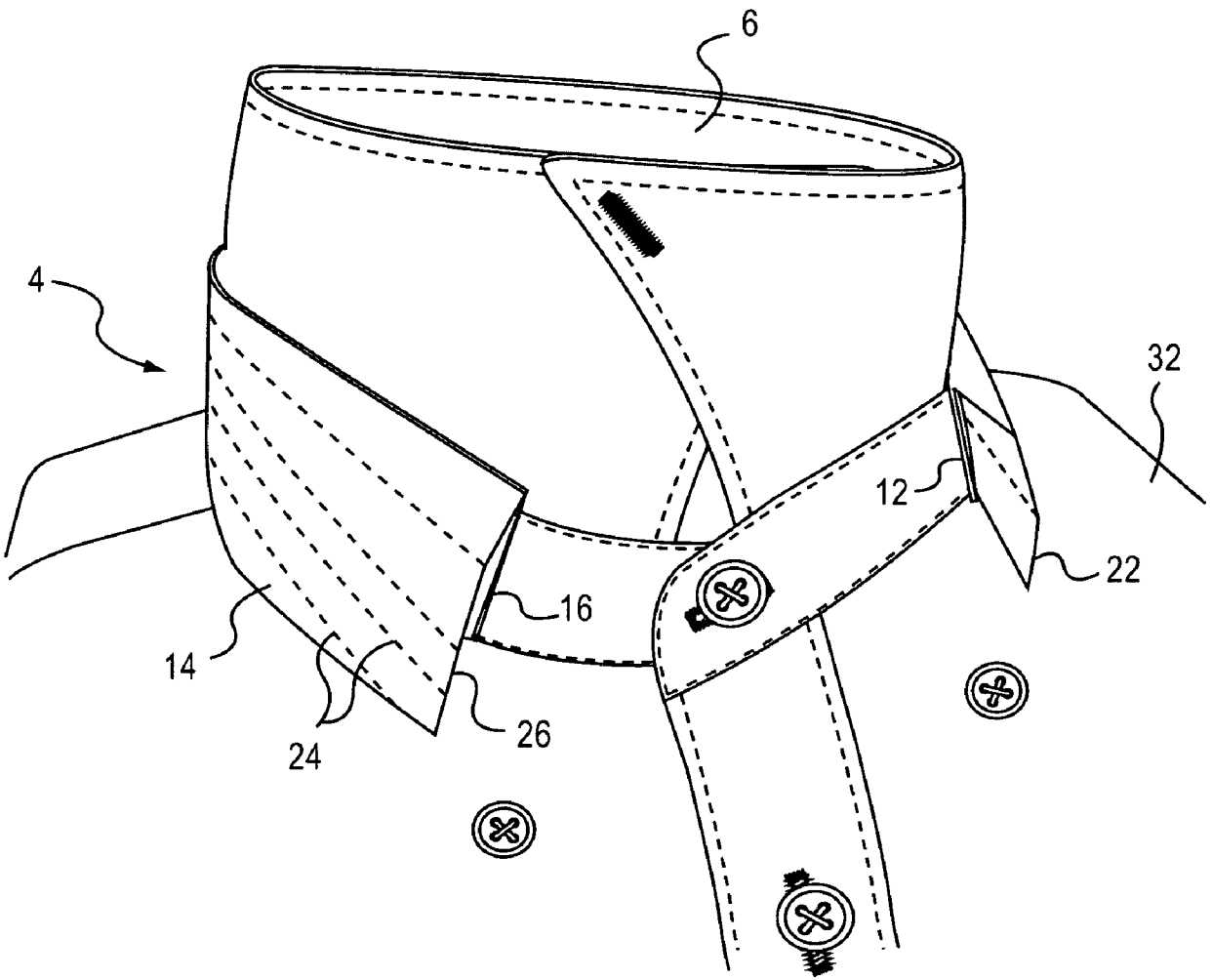
FIG. 4 illustrates the winged collar support in operation, according to an embodiment of the present invention.

The rows of scoring can be spaced apart at uniform intervals as shown in FIG. 1. For example, the rows of scoring can be spaced at least one-eighth of an inch apart. In the wings, the spacing of the rows at the outer sides 22, 26 can be greater than the spacing of the rows at the inner sides 28, 30, as shown in FIGS. 1 and 4 so that when the wings are folded over the elongated body portion 10, the collar support 4 can have a curvature that conforms to the shape of a variety of shirt collars.

Figure 3:
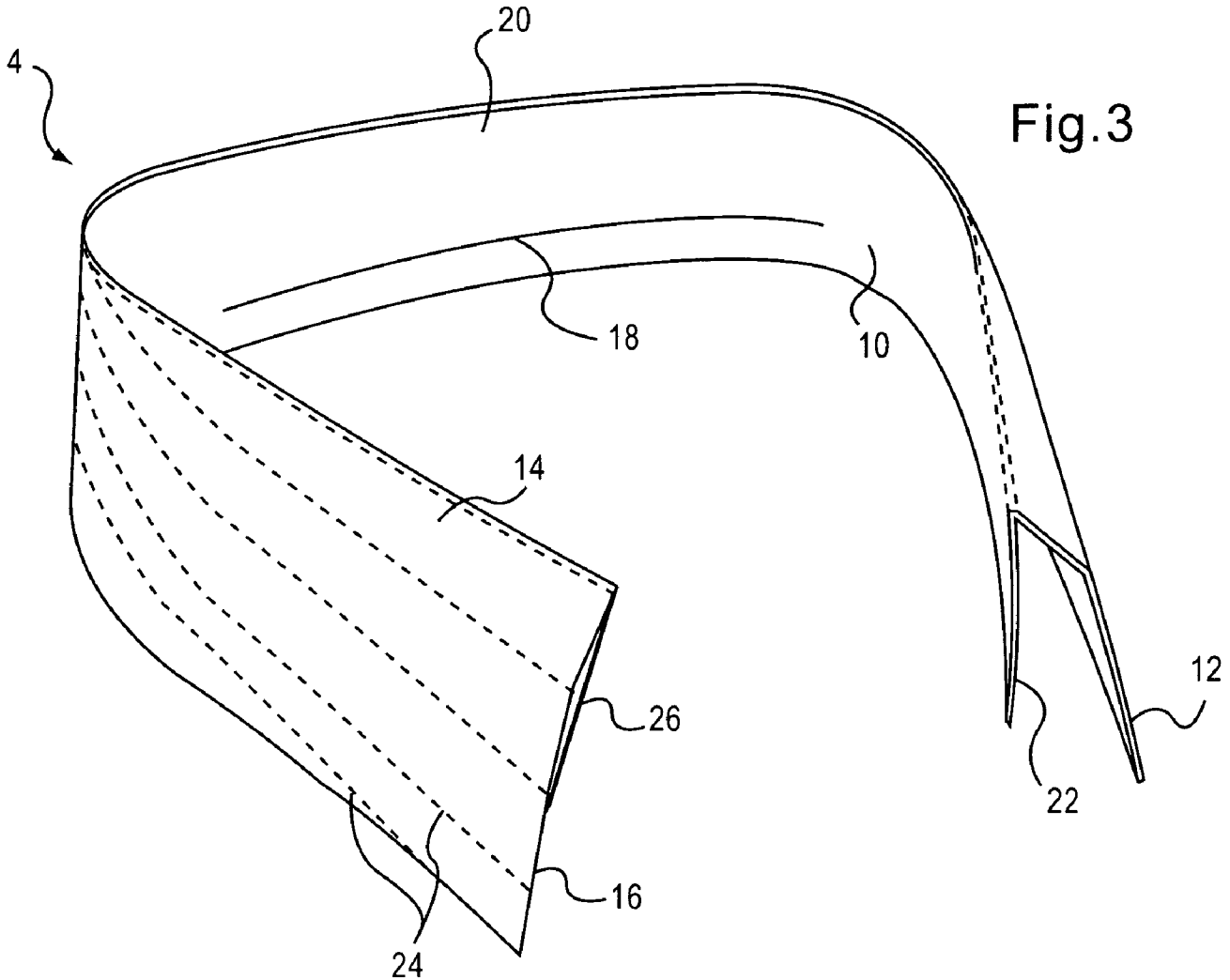
FIG. 3 illustrates the winged collar support with the wings folded along one row of scoring, according to an embodiment of the present invention.

As shown in FIGS. 1 and 3, the winged collar support can also include a longitudinal slit 18 in the center portion 20 of the elongated body portion 10. The slit 18 is shown as extending longitudinally across the central portion 20 of the elongated body portion between the wings. The slit 18 can be provided for holding a shirt board.

The winged collar support 4 of the present invention can be formed from a single sheet of paper-based material. The paper-based material can include a renewable and recyclable material such as cardboard or chipboard. The chipboard can be formed from at least a two-ply cardboard. In addition, the winged collar support 4 of the present invention is 100% biodegradable.

Further, the weight of the stock from which the elongated body portion is made is in a range of 0.0250 inches to 0.0290 inches in thickness.

The thickness (or caliper) of the cardboard or chipboard stock can be selected to provide the necessary structural rigidity to the collar support of the present invention. It has been found that a caliper of ranging from about 18 to 26 is mil particularly suitable for use in the present invention, as the end product must be able to withstand the bending forces of packaging, load carrying, shipping, as examples, while maintaining a predetermined shape. Consequently, the paperboard products are usually formed from two or more plies of material to provide the required stiffness.

The present invention also includes a method of forming the winged collar support 4 for fitting around the neckband of the folded shirt. As shown in FIG. 3, the method includes folding the pair of wings 14, 14 along at least one of the plurality of rows of scoring in a downward direction toward the elongated body portion 10. The ends of the elongated body portion are then bent toward each other in a U-shape. Each wing is folded so that a top edge of the wing rests between one of the plurality of rows of notches and a bottom edge of the elongated body portion. For example, the top edge of each wing can correspond to or extends beyond a bottom edge of the elongated body portion 10. The winged collar support 4 is then fitted around the neckband of the folded shirt 32. Also, shown in FIG. 4, for example, the winged collar support is folded along the desired row of scoring and bent or curved to fit around the neckband of the shirt 32 prior to the collar being folded down and buttoned.

Although the invention has been described based upon these preferred embodiments, it would be apparent to those skilled in the art that certain modifications, variations, and alternative constructions would be apparent, while remaining within the spirit and scope of the invention. In order to determine the metes and bounds of the invention, therefore, reference should be made to the appended claims.

What is claimed is:

1. A support for a shirt collar comprising:

the collar support comprising an elongated body portion having a first end, a second end, and a center portion having a uniform height, a pair of wings integral with and protruding from one of the first and second ends of the elongated body portion, each wing having an inner side facing the center portion of the elongated body portion and an outer side opposite to the inner side, wherein the height of the center portion of the elongated body is smaller than a height of the first and second ends of the elongated body; and a plurality of rows of notches formed in each wing, the plurality of rows of notches extending from the inner side to the outer side of each wing, wherein each plurality of rows of notches comprise more than two rows of notches.

2. The support for a shirt collar according to claim 1, wherein the elongated body portion has a uniform thickness.

3. The support for a shirt collar according to claim 1, wherein the plurality of rows of notches are spaced apart at uniform intervals.

4. The support for a shirt collar according to claim 3, wherein the plurality of rows of notches are spaced apart by at least one-eighth of an inch.

5. The support for a shirt collar according to claim 1, wherein the spacing of the plurality of rows of notches at the outer end of each wing is greater than the spacing of the plurality of rows of notches at the inner end of each wing.

6. The support for a shirt collar according to claim 1, wherein the notches are embedded in the wing to a depth from a surface of up to one-half the thickness of the wing.

7. The support for a shirt collar according to claim 1, further comprising a longitudinal slit in the center portion of the elongated body portion.

8. The support for a shirt collar according to claim 1, wherein the elongated body portion is a paper-based material.

9. The support for a shirt collar according to claim 8, wherein the paper-based material is cardboard.

10. The support for a shirt collar according to claim 1, wherein the elongated body portion is formed from a renewable and recyclable material.

11. The support for a shirt collar according to claim 1, wherein the plurality of rows of notches comprise longitudinal ends on the inner side and the outer side of each wing, and wherein the longitudinal ends on the inner side are non-contiguous.

12. A multi-scored winged collar support for a shirt comprising the collar support comprising an elongated body portion having a first end, a second end and a center portion having a uniform height;

a pair of wings, each wing integral with and protruding from one of the first and second ends of the elongated body portion and having an inner side facing the center portion of the elongated body portion and an outer side opposite to the inner side, wherein the height of the center portion of the elongated body is smaller than a height of the first and second ends of the elongated body; and a plurality of rows of uniform scoring formed in each wing, the plurality of rows extending from the inner side to the outer side of the wing and substantially parallel to a bottom surface of the elongated body portion, wherein each plurality of rows of uniform scoring comprise more than two rows of uniform scoring.

13. The multi-scored winged collar support according to claim 12, further comprising a longitudinal slit in the center portion of the elongated body portion.

14. The multi-scored winged collar support according to claim 12, wherein the pair of wings protrude in the same direction from the elongated body portion.

15. The multi-scored winged collar support according to claim 12, wherein the scoring is embedded in the pair of wings on one surface only.

16. The multi-scored winged collar support according to claim 15, wherein the plurality of rows of uniform scoring comprise longitudinal ends on the inner side and the outer side of each wing, and wherein the longitudinal ends are adjacent to each other.

17. The multi-scored winged collar support according to claim 16, wherein the longitudinal ends on the inner side are non-contiguous.

18. The multi-scored winged collar support according to claim 12, wherein the plurality of rows of scoring are spaced apart at uniform intervals.

19. The multi-scored winged collar support according to claim 12, wherein the collar support is 100% biodegradable.

20. The multi-scored winged collar support according to claim 12, wherein the elongated body portion is formed from a renewable and recyclable material.

21. The multi-scored winged collar support according to claim 20, wherein the renewable and recyclable material comprises cardboard.

22. The multi-scored winged collar support according to claim 20, wherein the renewable and recyclable material comprises chipboard.

23. The multi-scored winged collar support according to claim 22, wherein the chipboard is formed from at least two-ply cardboard material.

24. The multi-scored winged collar support according to claim 20, wherein the weight of the stock from which the elongated body portion and pair of wings are made is in a range of 0.0250 inches to 0.0290 inches in thickness.

25. The multi-scored winged collar support according to claim 12 wherein the collar support is formed from recycled paperboard.

26. The multi-scored winged collar support according to claim 12 wherein the pair of wings have curved perimeter edges.

27. The multi-scored winged collar support according to claim 12, wherein the elongated body portion and plurality of wings are formed from a single sheet of material.

28. The multi-scored winged collar support according to claim 27, wherein the single sheet of material has a uniform thickness.

* * * * *